US009981373B2

(12) United States Patent
Chen et al.

(10) Patent No.: US 9,981,373 B2
(45) Date of Patent: May 29, 2018

(54) RATCHET WRENCH

(71) Applicants: Tsan-Lung Chen, Taichung (TW); Wen-Hao Yu, Taichung (TW); Ka-Chung Ho, Taichung (TW)

(72) Inventors: Tsan-Lung Chen, Taichung (TW); Wen-Hao Yu, Taichung (TW); Ka-Chung Ho, Taichung (TW)

(73) Assignee: TOP GOAL Enterprise Limited, Shanghai (CN)

( * ) Notice: Subject to any disclaimer, the term of this patent is extended or adjusted under 35 U.S.C. 154(b) by 149 days.

(21) Appl. No.: 15/156,330

(22) Filed: May 17, 2016

(65) Prior Publication Data

US 2017/0225318 A1 Aug. 10, 2017

(30) Foreign Application Priority Data

Feb. 4, 2016 (TW) ..... 105103657 A

(51) Int. Cl.
*B25G 1/08* (2006.01)
*B25B 13/46* (2006.01)
*B25B 13/56* (2006.01)

(52) U.S. Cl.
CPC ..... *B25G 1/085* (2013.01); *B25B 13/463* (2013.01); *B25B 13/56* (2013.01)

(58) Field of Classification Search
CPC ..... B25G 1/085; B25B 13/56
USPC ..... 81/60
See application file for complete search history.

(56) References Cited

U.S. PATENT DOCUMENTS 4,302,990 A * 12/1981 Chrichton ..... B25G 1/085 206/378
RE31,140 E * 2/1983 Martinmaas ..... B25G 1/085 206/378
4,727,782 A * 3/1988 Yang ..... B25B 13/06 81/124.4
6,405,618 B1 * 6/2002 Sorensen ..... B25G 1/085 81/177.4
6,571,669 B2 * 6/2003 Benatz ..... B25G 1/085 206/350
2011/0061499 A1 * 3/2011 Franklin ..... B25B 13/463 81/60

* cited by examiner

*Primary Examiner* — Hadi Shakeri

(57) ABSTRACT

A ratchet wrench includes a first room, a second room, an engaging portion, a third room and a first groove in the function end thereof. Multiple ratchet wheels are received in the third room and one of which is rotatably received in the first room. Each ratchet wheel includes a first pivotal portion, a second pivotal portion and a first toothed portion which is defined in a curved and concaved manner in the outer periphery of the ratchet wheel. A pawl is located in the second room and has a second toothed portion which is engaged with the first toothed portion of the ratchet wheel. The distance defined between the deepest point of the first toothed portion to the first pivotal portion or the second pivotal portion is larger than the distance that the ratchet wheel shifts relative to the pawl within the first room.

6 Claims, 13 Drawing Sheets

RATCHET WRENCH

BACKGROUND OF THE INVENTION

1. Fields of the Invention

The present invention relates to a wrench, and more particularly, to a ratchet wrench with simplified structure.

2. Descriptions of Related Art

The conventional ratchet wrench known to applicant is disclosed in U.S. Pat. No. 8,042,433 and comprises a handle having at least one end forming a head portion. The head portion forms a hollow collar chamber having a bottom forming a support flange. The collar chamber has a circumferential wall forming a switching channel, and the switching channel has an inner wall defining a receiving slot. The head portion has a top surface to which a lid plate is fixed. The lid plate has an edge forming a one-side open operation cutoff. The cutoff has an opposite wall forming a release notch. A driving collar which is received in the collar chamber and positioned on the support flange. The driving collar has an outer circumferential surface forming a plurality of ratcheting teeth. The driving collar forms a circumferential positioning groove in the outer circumferential surface at a location close to a top thereof. A pawl member is received in the switching channel and forms a plurality of ratcheting teeth engageable with the driving collar. The pawl member forms a positioning peg corresponding to the circumferential positioning groove in a middle portion close to a top thereof. The top of the pawl member is coupled through a linking bar to a pusher pad that is positioned on and movable along a top surface of the lid plate. A retention block is received in the receiving slot and forms a bore that comprises a rear section forming an inner shoulder. The bore movably receives therein a push bar having a step section. A resilient biasing element is arranged between the push bar and an inside wall.

However, there are too many parts involved in this wrench and significant time for assembly is required. There is a recess defined in the handle so as to receive the lid plate, it is noted that the recess is not a circular recess which requires a specific machining milling method to create so that the manufacturing cost is increased. Besides, the handle further has a receiving slot to accommodate the retention block. Again, the receiving slot is not a circular slot and is created by way of milling which requires higher manufacturing cost.

The present invention intends to provide a ratchet wrench to eliminate the shortcomings mentioned above.

SUMMARY OF THE INVENTION

The present invention relates to a ratchet wrench and comprises a first room, a second room, an engaging portion, a third room and a first groove in the function end thereof. Multiple ratchet wheels are received in the third room and one of which is rotatably received in the first room. Each ratchet wheel includes a first pivotal portion, a second pivotal portion and a first toothed portion which is defined in a curved and concaved manner in the outer periphery of the ratchet wheel. A pawl is located in the second room and has a second toothed portion which is engaged with the first toothed portion of the ratchet wheel. The distance defined between the deepest point of the first toothed portion to the first pivotal portion or the second pivotal portion is larger than the distance that the ratchet wheel shifts relative to the pawl within the first room.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
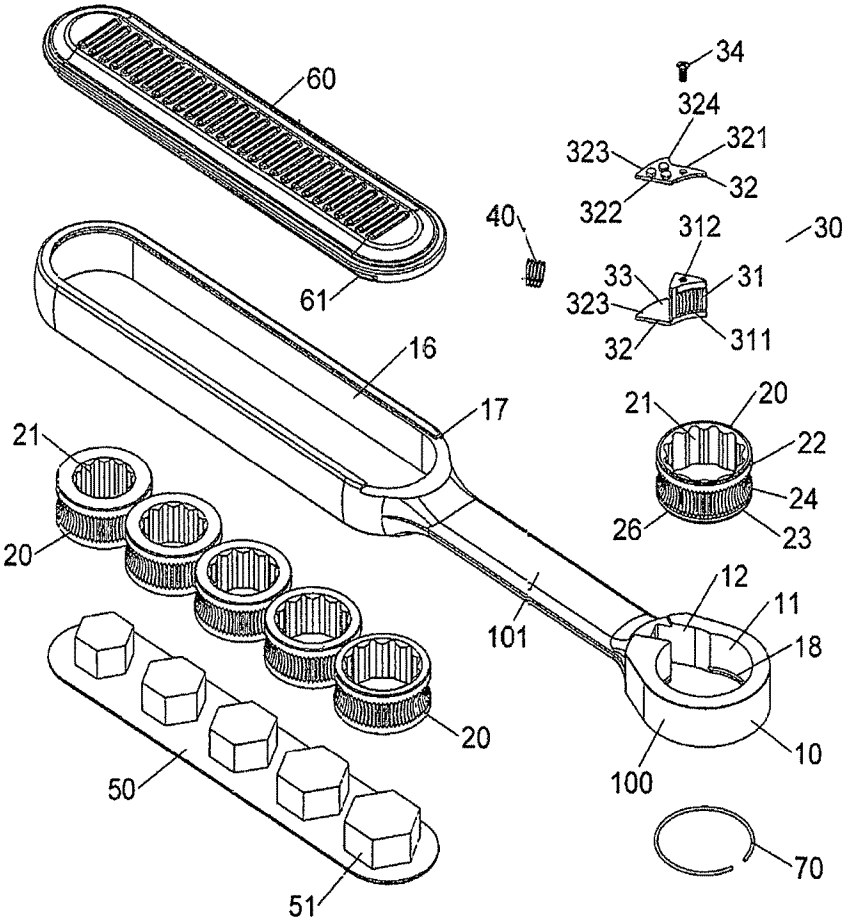
FIG. 1 is an exploded view of the ratchet wrench of the present invention.
Figure 2:
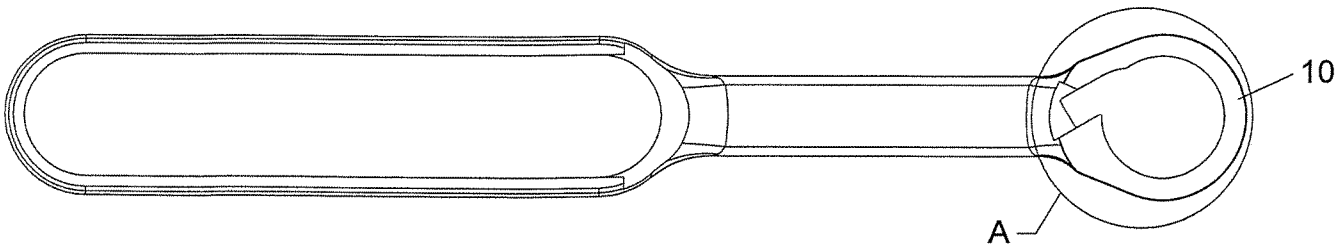
FIG. 2 is a top view of the ratchet wrench of the present invention.
Figure 3:
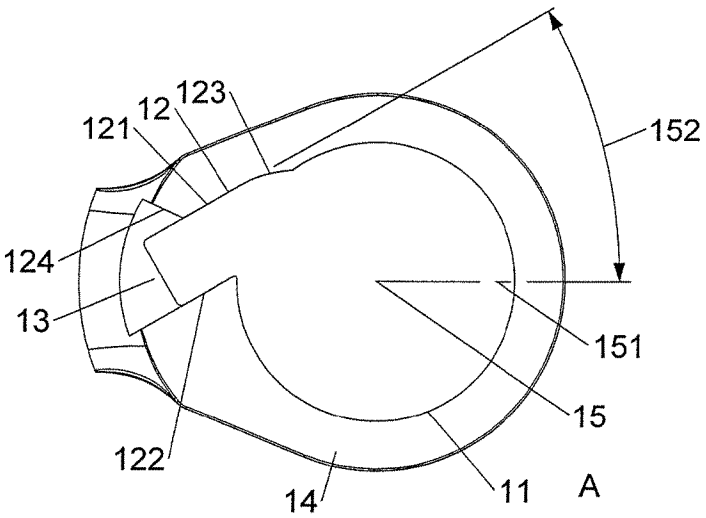
FIG. 3 is an enlarged view of the circled "A" in FIG. 2.
Figure 4:
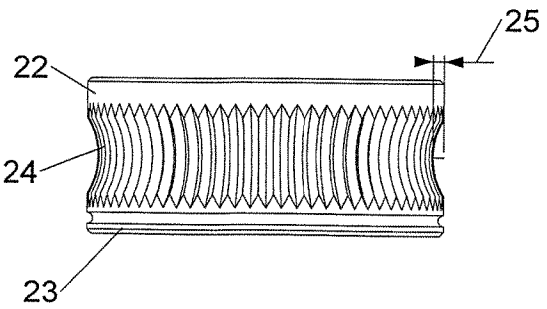
FIG. 4 shows the ratchet wheel of the ratchet wrench of the present invention.
Figure 5:
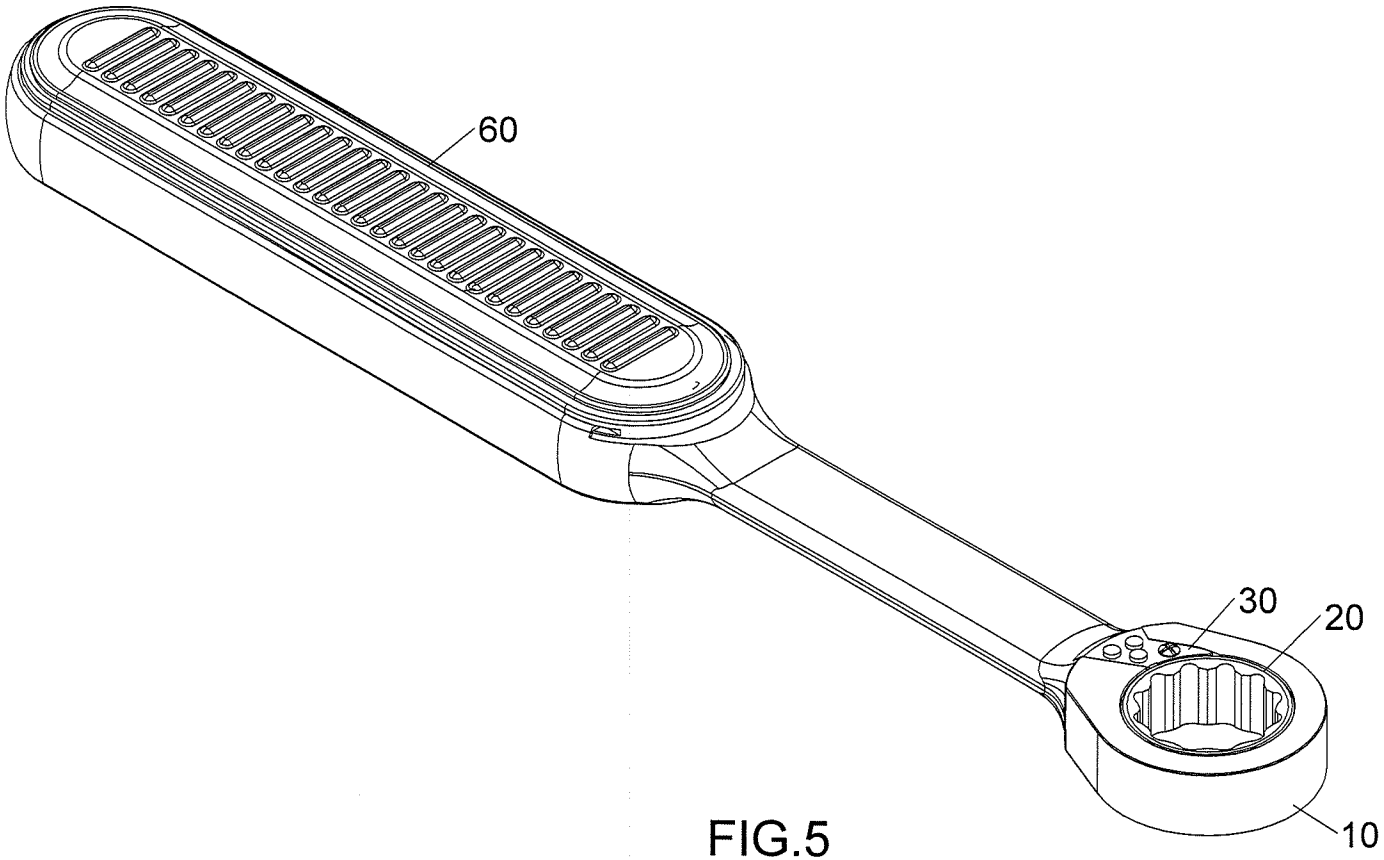
FIG. 5 is a perspective view of the ratchet wrench of the present invention.
Figure 6:
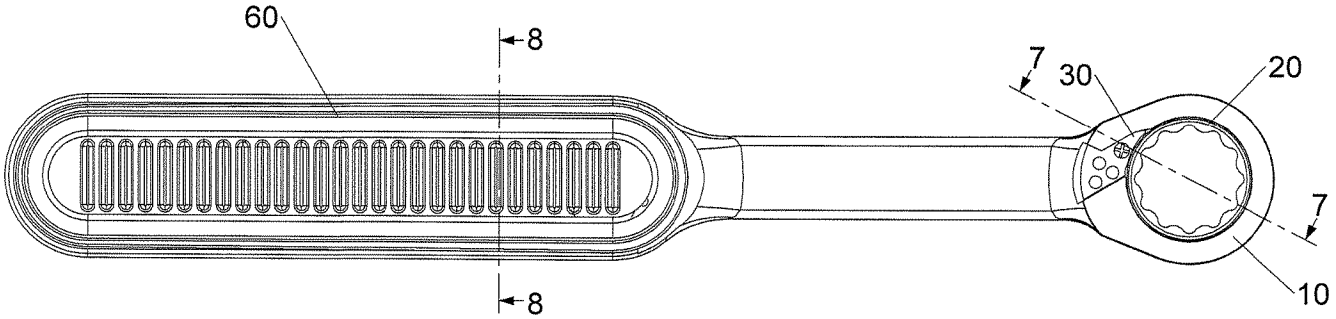
FIG. 6 is a top view of the ratchet wrench of the present invention, wherein the cover is connected to the handle.
Figure 7:
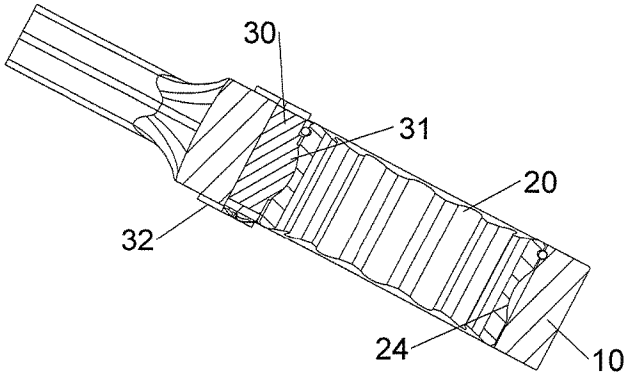
FIG. 7 is a cross sectional view, taken along line 7-7 in FIG. 6.
Figure 8:
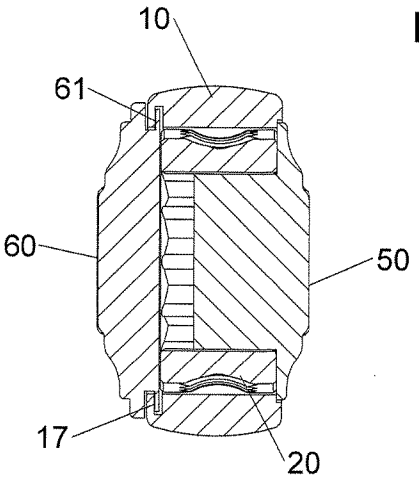
FIG. 8 is a cross sectional view, taken along line 8-8 in FIG. 6.

Referring to FIGS. 1 to 4, the ratchet wrench 10 of the present invention comprises a function end 100 and a handle 101, wherein the function end 100 has a circular first room 11 defined through the top 14 and the bottom thereof, and a second room 12 is defined in the inner periphery of the first room 11 and communicates with the top 14 and the bottom of the function end 100. The second room 12 includes a first face 121 and a second face 122 which is parallel to the first face 121. A curved third face 123 is connected between the first face 121 and the inner periphery of the first room 11. A minimum width is defined at the conjunction area between the first and second rooms 11, 12. The second room 12 has a first contact portion 124 formed at the inner end thereof and the first contact portion 124 is located on the same side as the first face 121. The second room 12 has an engaging portion 13 defined at the inner end thereof which is located close to the first contact portion 124. The thickness between the top 14 and the bottom corresponding to the first room 11 of the function end 100 is thicker than the thickness of the engaging portion 13. The thickness of the engaging portion 13 is thinner than that of the second room 12. An angle 152 is defined between the first face 121 and an axial axis 151 of the handle 101 passing through the center of the first room 11. The angle 152 is in a range between 20 to 60 degrees, preferably, between 30 to 45 degrees. The handle 101 has a third room 16 defined therein. The third room 16 is an elongate room and a first rail 17 is located on at least one of the top and the bottom of the handle 101. A first groove 18 is defined in the inner periphery of the first room 11 and located close to one of the top and bottom of the function end 100.

Multiple ratchet wheels 20 are received in the third room 16 and one of the ratchet wheels 20 is rotatably received in the first room 11. Each ratchet wheel 20 has a first mounting portion 21 which is a polygonal hole or a rectangular protrusion, and the first mounting portions 21 of the multiple ratchet wheels 20 are different from each other. Each ratchet wheel 20 has a first pivotal portion 22 formed on the upper periphery thereof, and each ratchet wheel 20 has a second pivotal portion 23 formed on the lower portion thereof. A first toothed portion 24 is defined in the outer periphery of each of the ratchet wheels 20 and located between the first and second pivotal portions 22, 23 corresponding thereto. The first and second pivotal portions 22, 23 of each ratchet wheel 20 are rotatably engaged with the inner periphery of the first room 11. The first and second pivotal portions 22, 23 are located symmetrically to each other relative to the first toothed portion 24. An annular second groove 26 is defined in the second pivotal portion 23 of each ratchet wheel 20. The first toothed portion 24 is defined in a curved and concaved manner in the outer periphery of each of the ratchet wheels 20. A distance defined between the deepest point of the first toothed portion 24 to the first pivotal portion 22 or the second pivotal portion 23 is larger than the distance that the ratchet wheel 20 shifts within the first room 11.

A pawl unit 30 has a pawl 31, two engaging plates 32 and a bolt 34. The pawl 31 is linearly movable within the second room 12 and along the first face 121 or the second face 122. The pawl 31 has a second toothed portion 311 which is defined in a curved and convex end of the pawl 31. The second toothed portion 311 is engaged with the first toothed portion 24. The pawl 31 has a threaded hole 312 and is connected between the two engaging plates 32 which are located symmetrically to each other relative to the pawl 31. The two engaging plates 32 are in flush with the top 14 and the bottom of the function end 100. A third face 321 and a fourth face 322 are respectively formed on two sides of each of the two engaging plates 32, and the third and fourth faces 321, 322 are respectively slidable along the first and second faces 121, 122. Each of the engaging plates 32 has a distal end 323. The engaging portion 13 is located between the two distal ends 323 of the two engaging plates 32 so that the pawl 31 is not disengaged from the second room 12. Each engaging plate 32 has a second contact portion 324 which contacts the first contact portion 124 so as to restrict the pawl 31 from entering into the first room 11 when the pawl 31 is moved in the second room 12. A space 33 is defined between the two engaging plates 32. The bolt 34 extends through the two engaging plates 32 and is connected to the threaded hole 312 to connect the two engaging plates 32 to the pawl 31. The distal ends 323 is restricted by the engaging portion 13 so as to receive the pawl unit 30 in the second room 12. The ratchet wheel 20 is engaged with the pawl 31 and located in the first room 11, when the ratchet wheel 20 shifts relative to the pawl 31 in the first room 11;

A spring 40 is located in the space 33 and biased between the second room 12 and the pawl 31.

A seat 50 is located in the third room 16 to seal a bottom of the third room 16. The seat 50 has multiple second mounting portions 51 which are hexagonal protrusions. The second mounting portions 51 are accommodated in the first mounting portions 21 of the ratchet wheels 20 in the third room 16. A cover 60 has a second rail 61 which is slidably engaged with the first rail 17 to seal and the top of the third room 16.

A clip 70 is engaged with the first and second grooves 18, 26. When the pawl 31 shifts in the second room 12, the ratchet wheel 20 is restricted by the clip 70 so as to be located within the first room 11. The ratchet wheel 20 is disengaged from the first room 11 by pushing the ratchet wheel 20.

As shown in FIGS. 5 to 8, the ratchet wheel 20 is rotatably received in the first room 11, and the pawl 31 is received in the second room 12. The first and second toothed portions 24, 311 are engaged with each other. The engaging portion 13 is clamped between the two engaging plates 32. The seat 50 is received in the third room 16 and has multiple second mounting portions 51 which are inserted into the first mounting portions 21 of the ratchet wheels 20 in the third room 16. The cover 60 covers the third room 16 by sliding the second rail 61 along the first rail 17.

Figure 9:
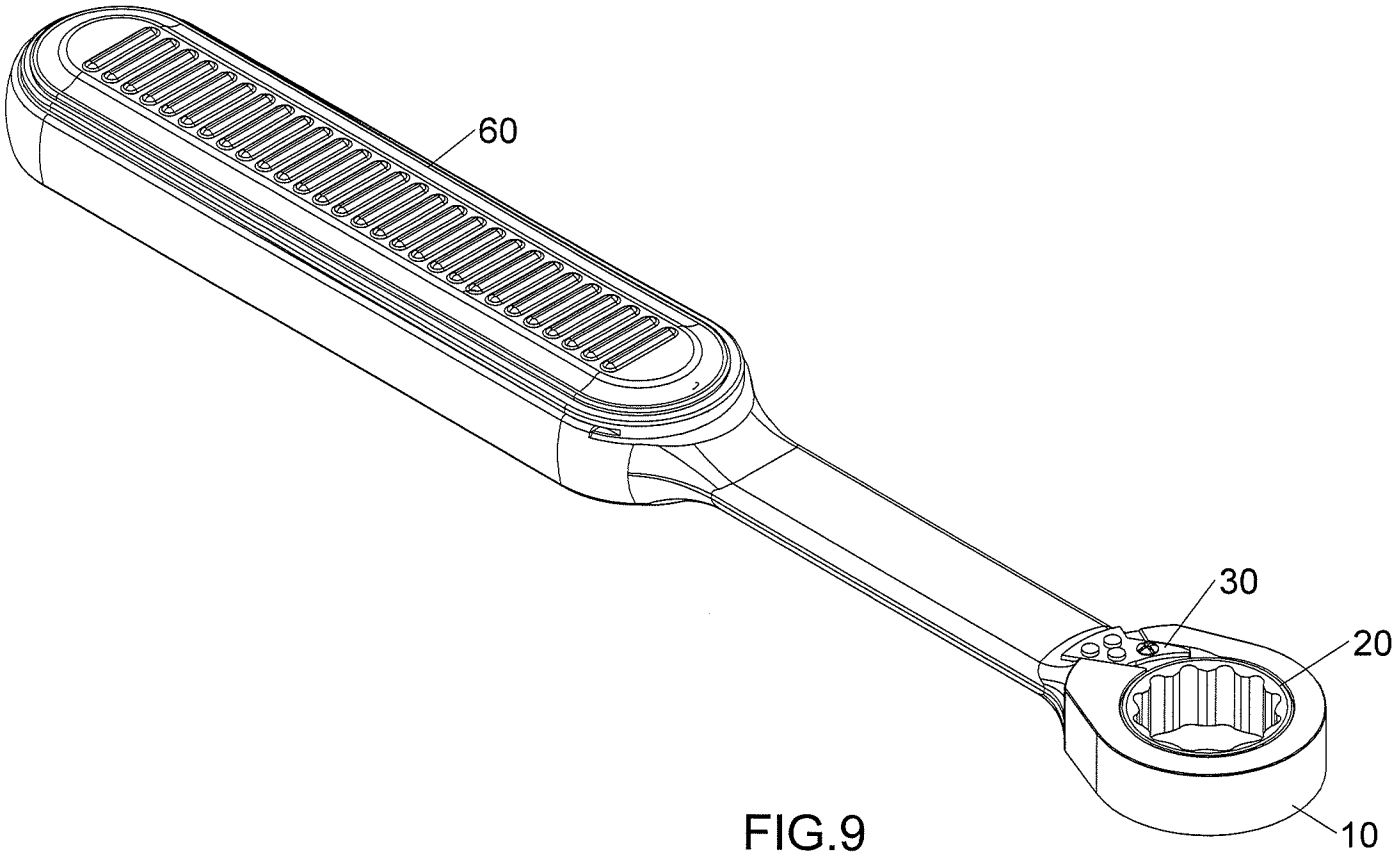
FIG. 9 shows the ratchet wrench of the present invention, wherein a ratchet wheel is received in the function end.

As shown in FIG. 9, when shifting the pawl unit 30, the pawl 31 moves from the second room 12 toward the engaging portion 13 and compresses the spring 40 to disengage the second toothed portion 311 from the first toothed portion 24. In other words, the distance that the pawl 31 moves in the second room 12 is longer than the distance 25 so as to remove the ratchet wheel 20 from the first room 11.

Figure 10:
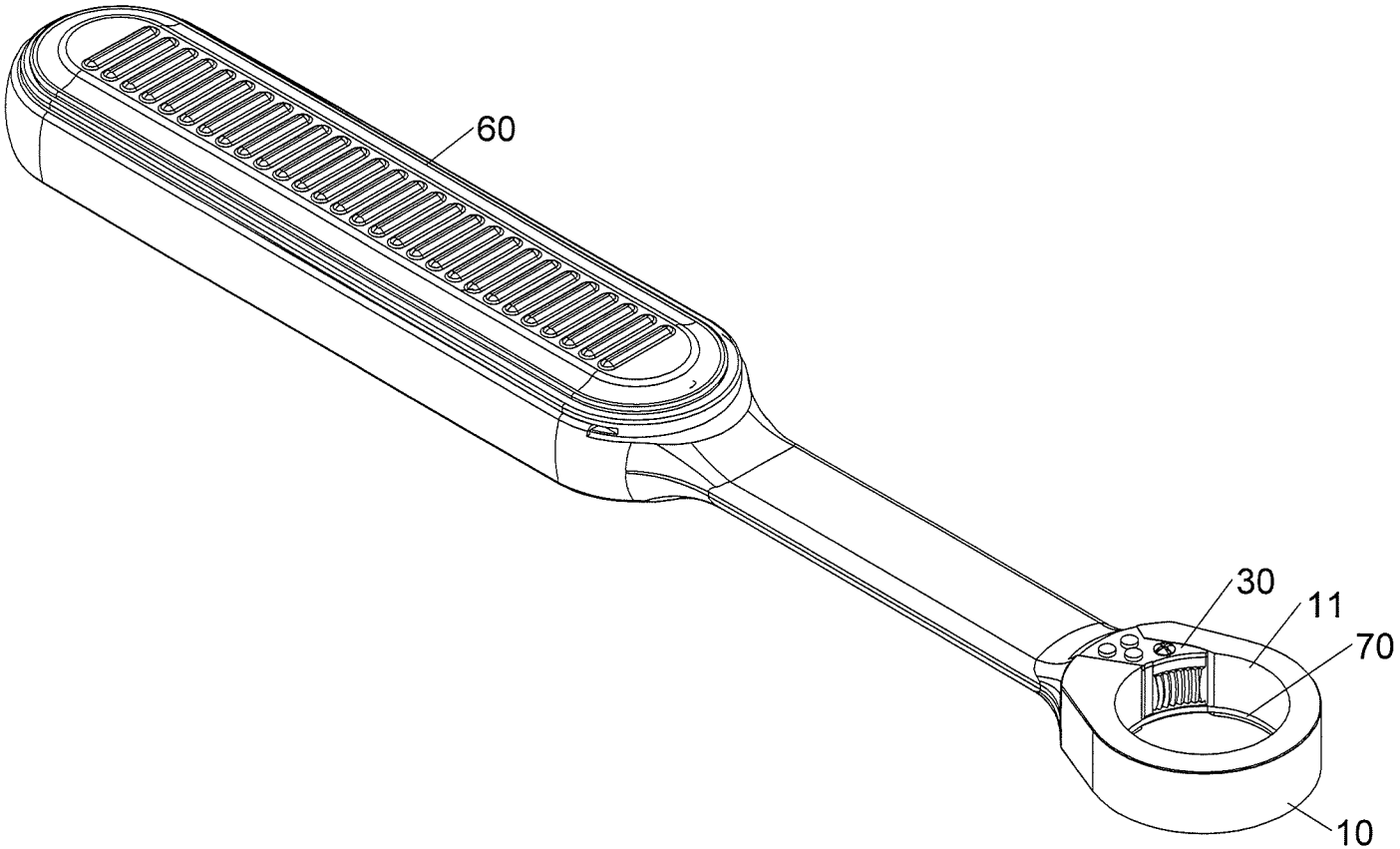
FIG. 10 shows the ratchet wrench of the present invention, wherein no ratchet wheel is received in the function end.

As shown in FIG. 10, when the ratchet wheel 20 is removed from the first room 11, the pawl 31 contacts the clip 70, and the pawl unit 30 is restricted by the clip 70 and retrained in the second room 12. The second contact portion 324 contacts the first contact portion 124, the pawl unit 30 is restricted by the first contact portion 124 and is not separated from the second room 12. The clip 70 and the first contact portion 124 provide two restriction features to restrict the movement of the pawl unit 30.

Figure 11:
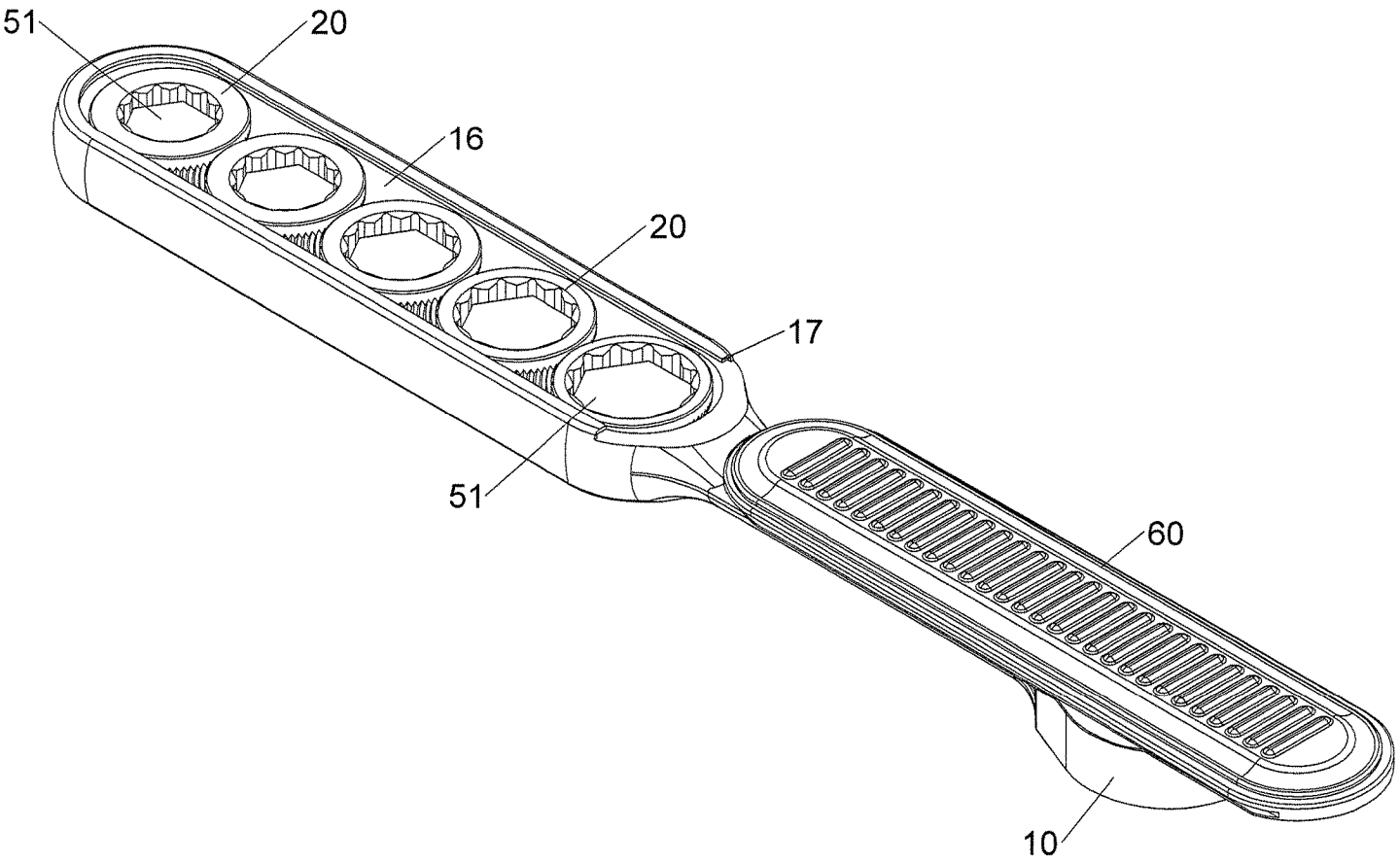
FIG. 11 shows the ratchet wrench of the present invention, wherein the cover is slid away from the third room to show the ratchet wheels in the third room.

As shown in FIG. 11, when the second rail 61 is slid away from the first rail 17, the third room 16 is exposed and the users may pick the specific ratchet wheel 20 from the third room 16 and install the ratchet wheel 20 into the first room 11. Therefore, the different ratchet wheels 20 can be used for different needs.

Figures 12, 13:
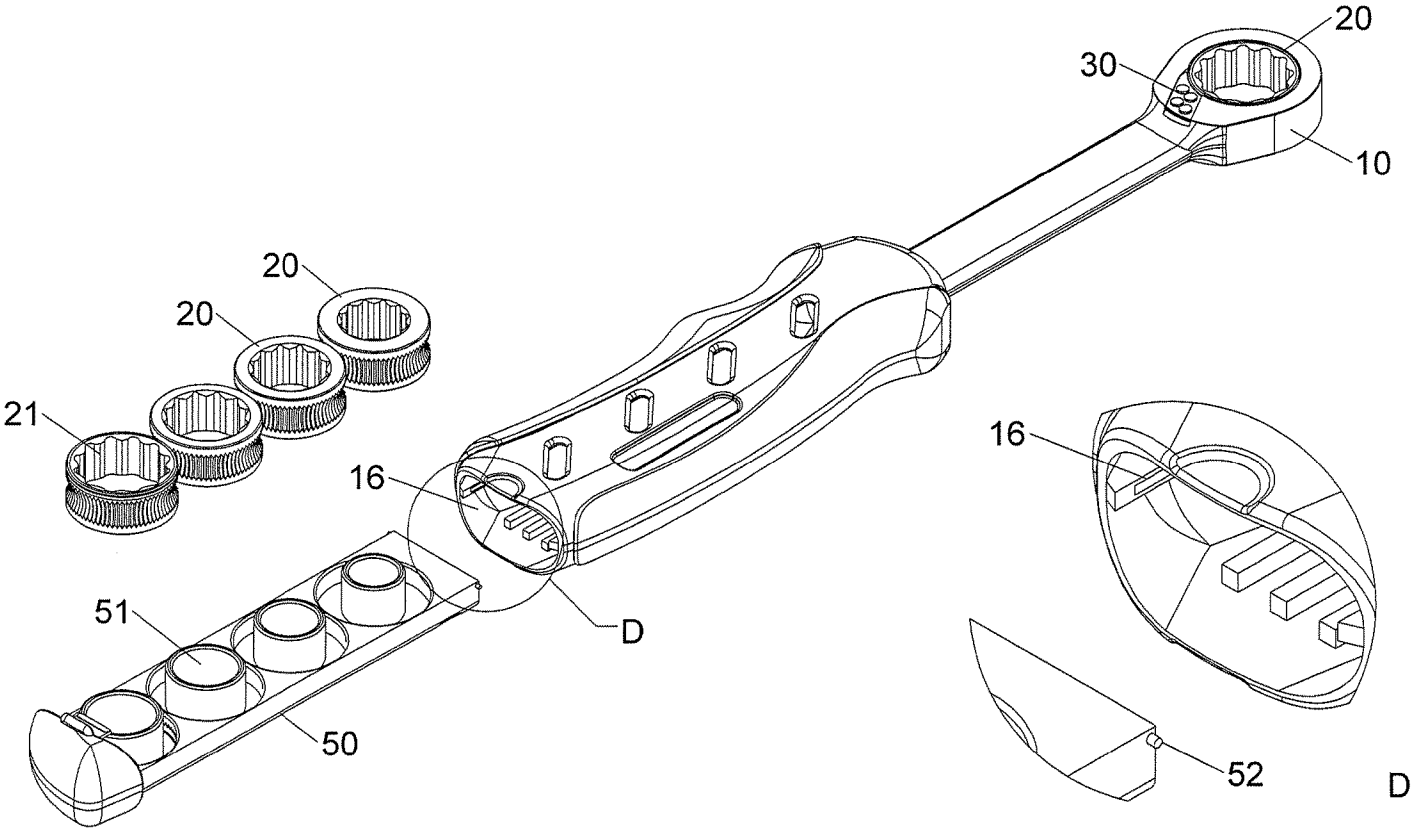
FIG. 12 is an exploded view to show the second embodiment of the ratchet wrench of the present invention.
FIG. 13 is an enlarged view of the circled "D" in FIG. 12.
Figure 14:
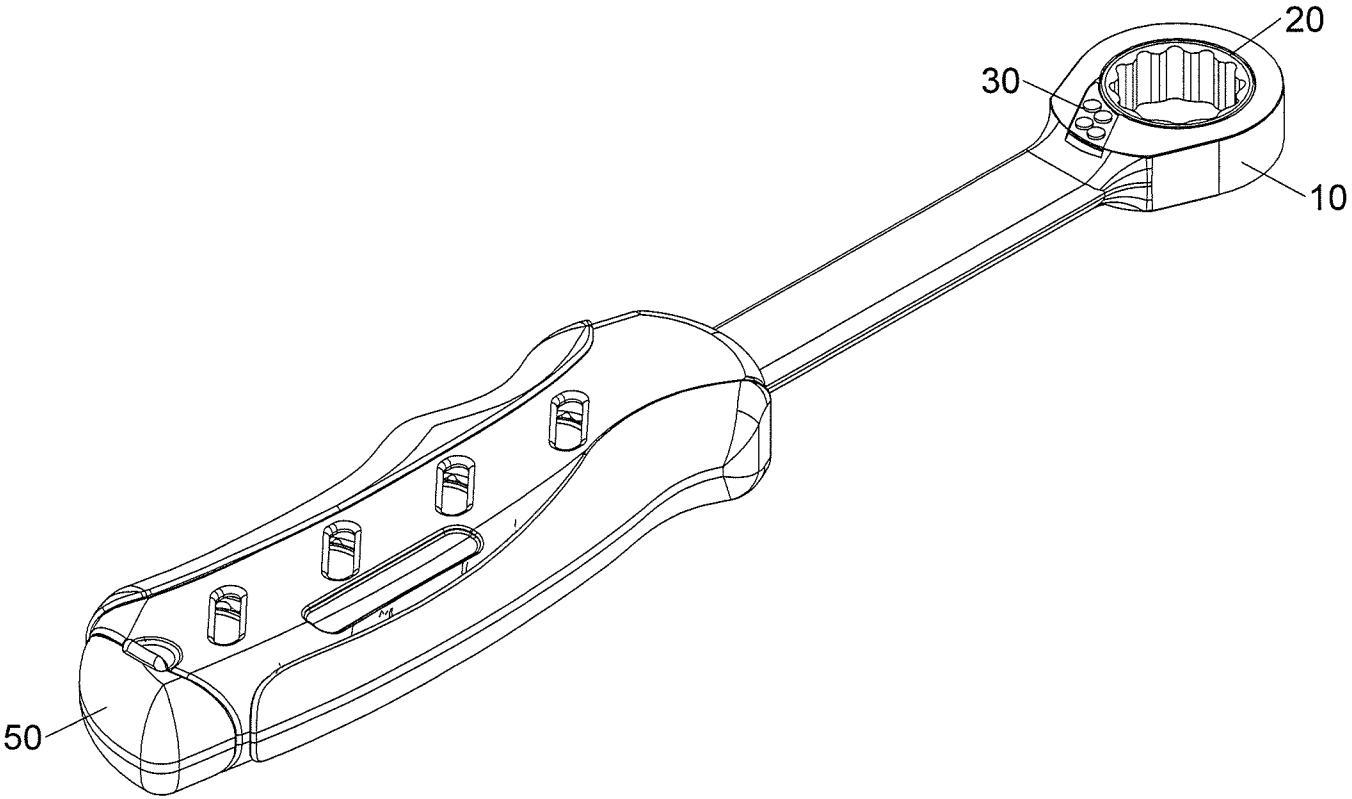
FIG. 14 is a perspective view to show the second embodiment of the ratchet wrench of the present invention.

As shown in FIGS. 12 and 13, the handle 101 has an open end in which the third room 16 is defined. A rail is defined in each of two insides of the third room 16. The seat 50 includes a rod 52 on each of two sides thereof, and the two rods 52 are slidably engaged with the rails of the third room 16. The seat 50 is received in the third room 16 and has multiple second mounting portions 51 which are cylindrical protrusions. The second mounting portions 51 are accommodated in the first mounting portions 21 of the ratchet wheels 20.

Figure 15:
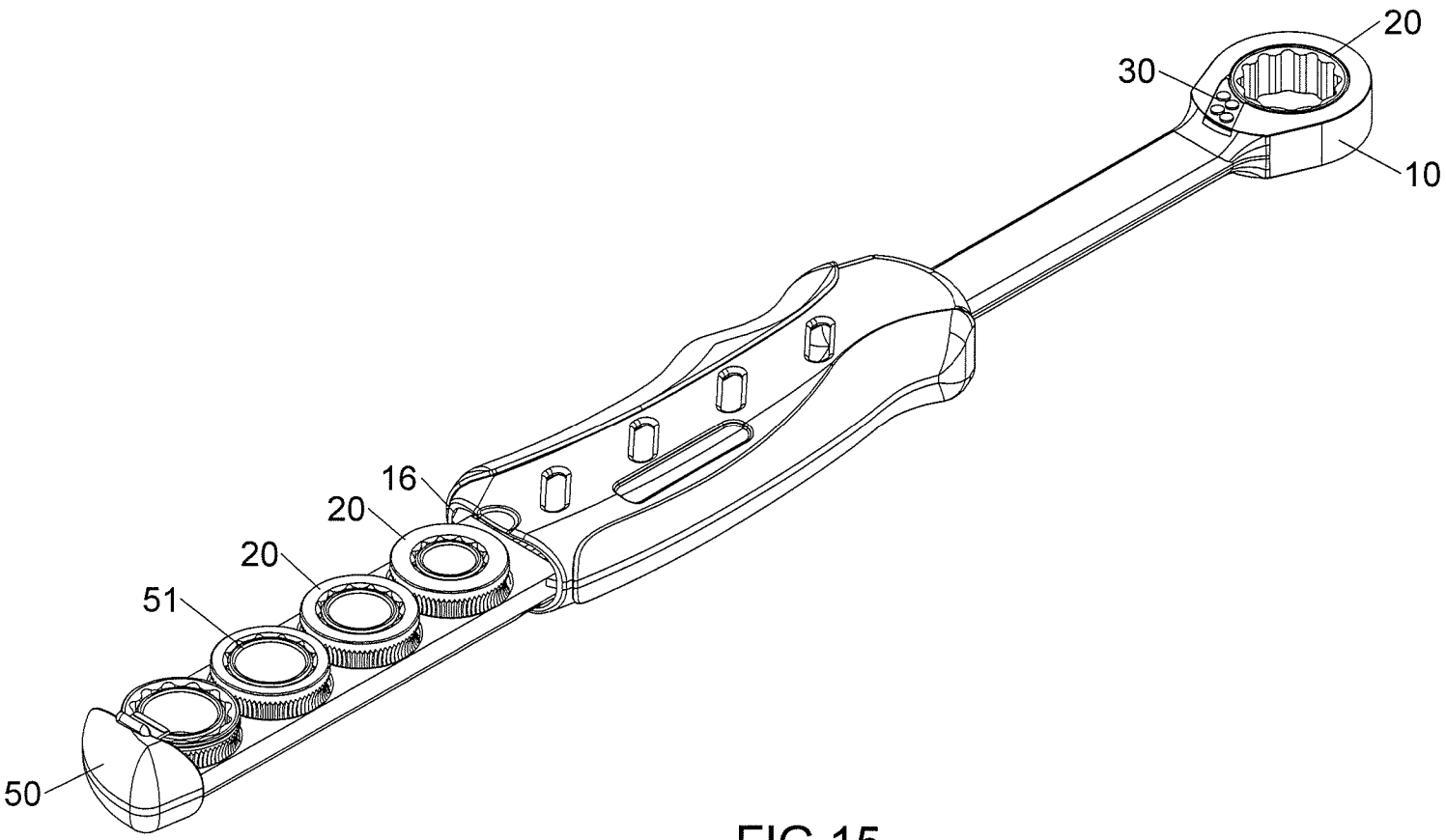
FIG. 15 shows that the seat is pulled out from the third room of the second embodiment of the ratchet wrench of the present invention.

As shown in FIG. 15, the seat 50 is pulled out from the third room 16 to access the ratchet wheels 20.

Figure 16:
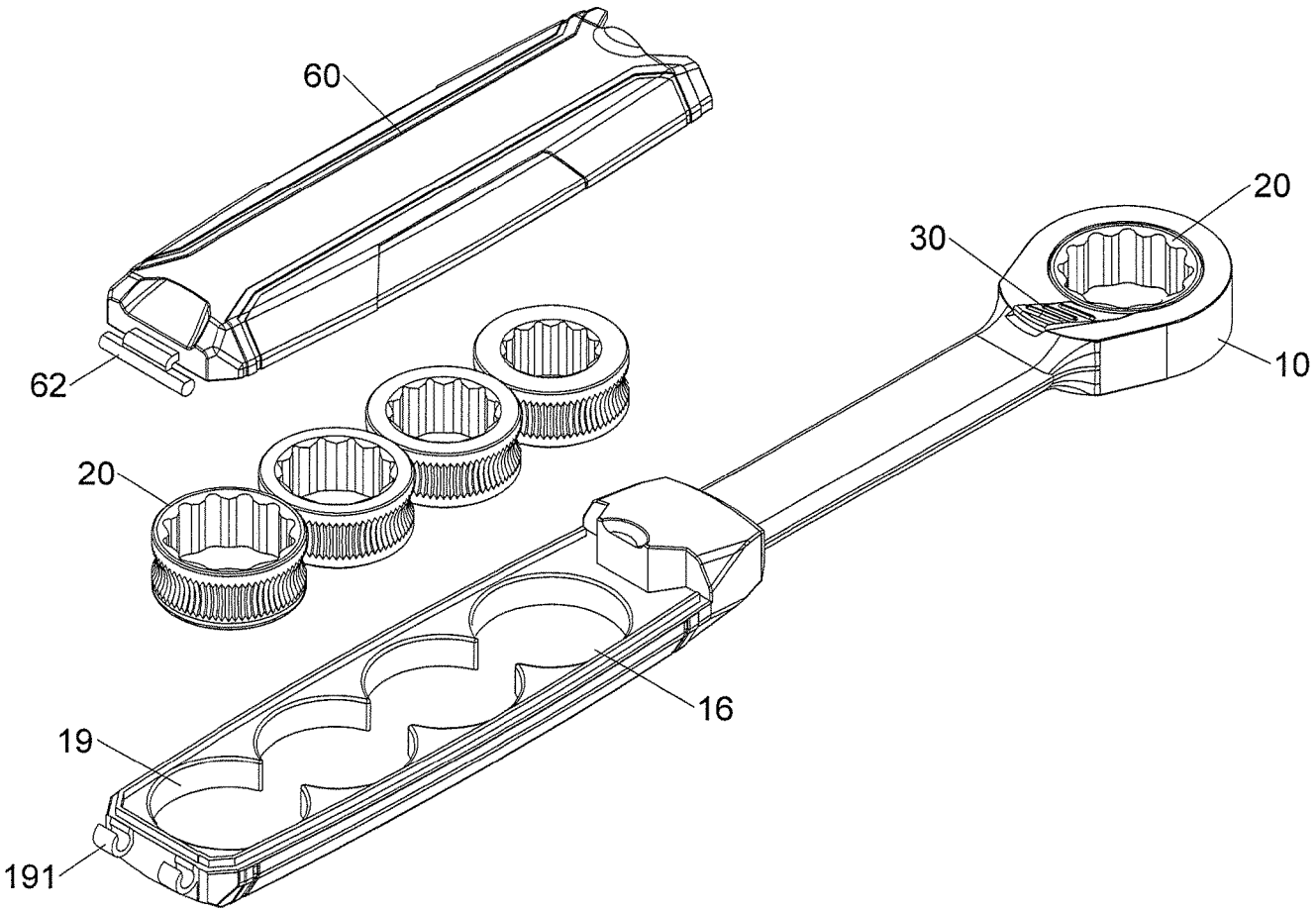
FIG. 16 is an exploded view to show the third embodiment of the ratchet wrench of the present invention.
Figure 17:
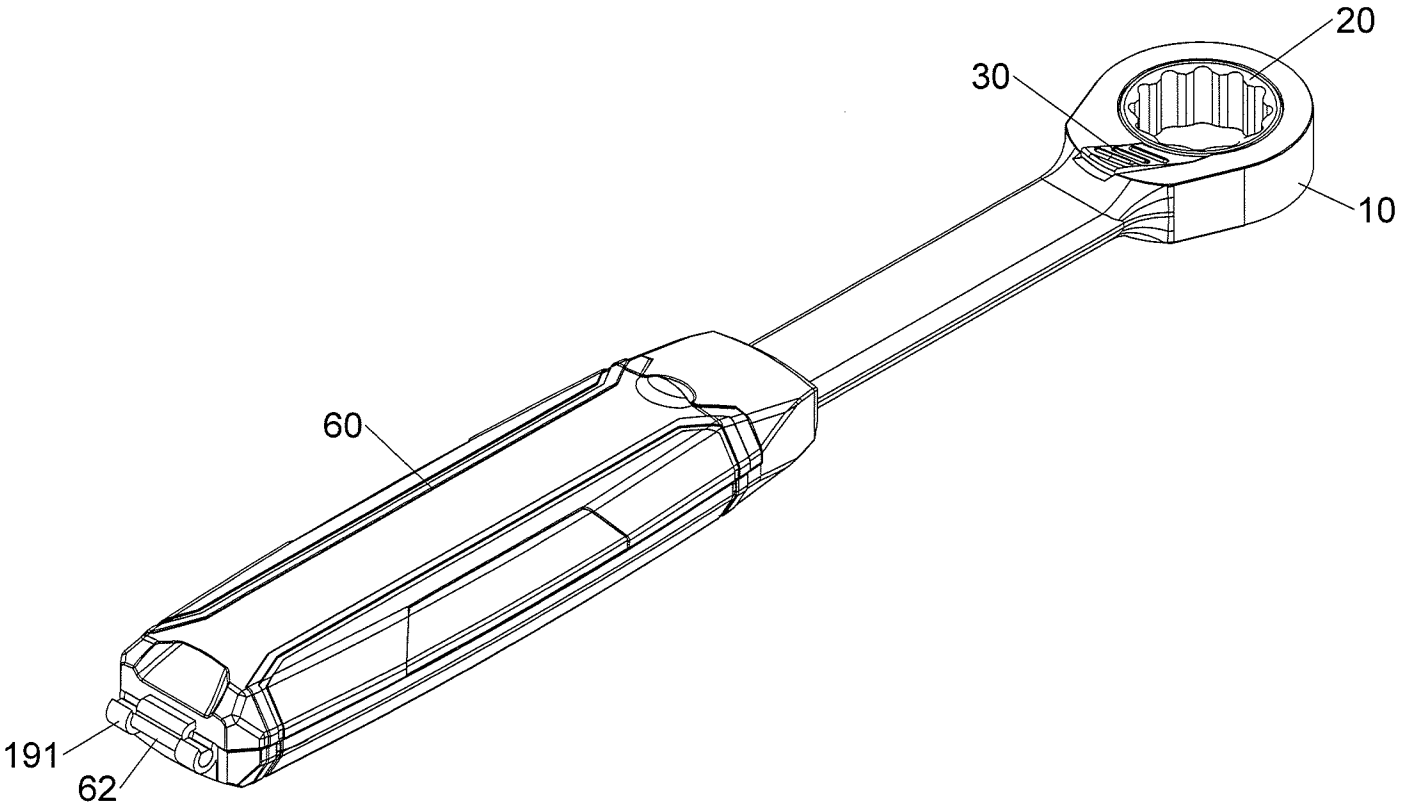
FIG. 17 is a perspective view to show the third embodiment of the ratchet wrench of the present invention.
Figure 18:
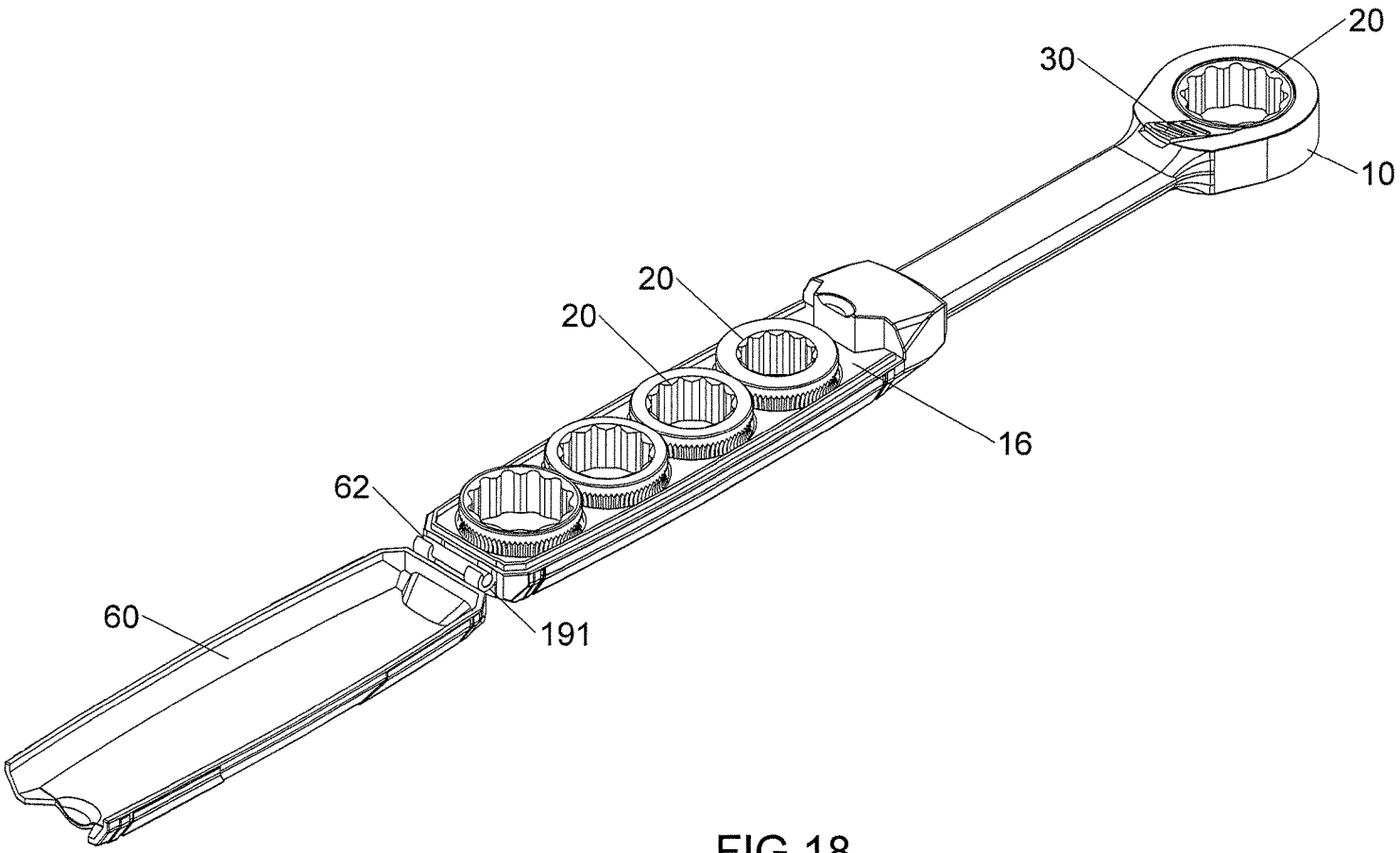
FIG. 18 is a perspective view to show that the cover is opened relative to the third room of the third embodiment of the ratchet wrench of the present invention.

FIG. 16 shows that the third room 16 has multiple recesses 19 defined therein, and each recess 19 receives one of the ratchet wheels 20. Two supports 191 are formed on one end of the handle 101. A cover 60 includes a pivot 62 which is pivotably connected to the two supports 191 so that the cover 60 is pivotable about the pivot 62 to be mounted to the handle 101 and seal the third room 16 as shown in FIG. 17. As shown in FIG. 18, the cover 60 is pivoted upward to open the third room 16.

The engaging plates 32 may be integral with the pawl 31. Alternatively, one of the two engaging plate 32 is connected to the pawl 31 by the bolt 34, the other one of the two engaging plate 32 is integral with the pawl 31.

The present invention ratchet has the advantages which are that there are less number of parts involved so that the manufacturing cost is low. The distal ends 323 of the engaging plates 32 are restricted by the engaging portion 13 to restrict the pawl unit 30 in the second room 12. The engagement between the first and second toothed portions 24, 311 so that the ratchet wheel 20 is retained in the first room 11. The distance 25 is defined to restrict the ratchet wheel 20 to be located in the first room when a relative movement between the pawl 31 and the ratchet wheel 20 happens.

When shifting the pawl unit 30, the pawl 31 moves from the second room 12 toward the engaging portion 13 and compresses the spring 40 to disengage the second toothed portion 311 from the first toothed portion 24. The distance that the pawl 31 moves in the second room 12 is longer than the distance 25 so as to remove the ratchet wheel 20 from the first room 11. The movement of the pawl 31 is easy for the user to operate.

There are multiple ratchet wheels 20 in the third room 16 and the users may pick any of them to be installed in the first room 11.

After the pawl 31 is moved in the second room 12, the ratchet wheel 20 is restricted by the clip 70 and is not separated from the first room 11. When the users pushes the ratchet wheel 20, it is able to be separated from the first room 11, and after the pawl 31 is moved, the ratchet wheel 20 is still restricted by the clip 20 to prevent from dripping to the ground by the resilient force of the clip 70.

When the ratchet wheel 20 is removed from the first room 11, the pawl 31 contacts the clip 70, and the pawl unit 30 is restricted by the clip 70 and retrained in the second room 12. The second contact portion 324 contacts the first contact portion 124, the pawl unit 30 is restricted by the first contact portion 124 and is not separated from the second room 12. The clip 70 and the first contact portion 124 provide two restriction features to restrict the movement of the pawl unit 30 as shown in FIG. 10.

The different ratchet wheels 20 can be used for different needs. When the second rail 61 is slid away from the first rail 17, the third room 16 is exposed and the users may pick the specific ratchet wheel 20 from the third room 16 and install the ratchet wheel 20 into the first room 11.

The first and second rooms 11, 12 communicate with each other so that the ratchet wrench can be manufactured by way of pressing which is less expensive than the method of milling.

While we have shown and described the embodiment in accordance with the present invention, it should be clear to those skilled in the art that further embodiments may be made without departing from the scope of the present invention.

What is claimed is:

1. A ratchet wrench comprising:

a function end and a handle, the function end having a circular first room defined through a top and a bottom thereof, a second room defined in an inner periphery of the first room and communicating with the top and the bottom of the function end, the second room including a first face and a second face which is parallel to the first face, a curved third face connected between the first face and the inner periphery of the first room, a minimum width defined at a conjunction area between the first and second rooms, the second room having a first contact portion formed at an inner end thereof, the first contact portion located on the same side as the first face, the second room having an engaging portion defined at the inner end thereof which is located close to the first contact portion, a thickness between the top and the bottom corresponding to the first room of the function end being thicker than a thickness of the engaging portion, a thickness of the engaging portion being thinner than that of the second room, an angle defined between the first face and an axial axis of the handle passing through a center of the first room, the angle being in a range between 20 to 60 degrees, the handle having a third room, a first groove defined in the inner periphery of the first room and located close to one of the top and bottom of the function end;

multiple ratchet wheels received in the third room and one of the ratchet wheels rotatably received in the first room, each ratchet wheel having a first mounting portion which is a polygonal hole or a rectangular protrusion, the first mounting portions of the multiple ratchet wheels being different, each ratchet wheel having a first pivotal portion formed on an upper periphery thereof, each ratchet wheel having a second pivotal portion formed on a lower portion thereof, a first toothed portion defined in an outer periphery of each of the ratchet wheels and located between the first and second pivotal portions corresponding thereto, the first and second pivotal portions of each ratchet wheel rotatably engaged with the inner periphery of the first room, the first and second pivotal portions being located symmetrically to each other relative to the first toothed portion, an annular second groove defined in the second pivotal portion of each ratchet wheel, the first toothed portion being defined in a curved and concaved manner in the outer periphery of each of the ratchet wheels, a distance defined between a deepest point of the first toothed portion to the first pivotal portion or the second pivotal portion, the distance being larger than a distance that the ratchet wheel shifts within the first room;

a pawl unit having a pawl, two engaging plates and a bolt, the pawl being linearly movable within the second room and along the first face or the second face, the pawl having a second toothed portion which is defined in a curved and convex end of the pawl, the second toothed portion being engaged with the first toothed portion, the pawl having a threaded hole, the pawl being connected between the two engaging plates which are located symmetrically to each other relative to the pawl, the two engaging plates being in flush with the top and the bottom of the function end, a third face and a fourth face respectively formed on two sides of each of the two engaging plates, the third and fourth faces respectively slidable along the first and second faces, each of the engaging plates having a distal end, the engaging portion being located between the two distal ends of the two engaging plates so that the pawl is not disengaged from the second room, each engaging plate having a second contact portion which contacts the first contact portion so as to restrict the pawl from entering into the first room when the pawl is moved in the second room, a space defined between the two engaging plates, the bolt extending through the two engaging plates and being connected to the threaded hole to connect the two engaging plates to the pawl, the distal ends being restricted by the engaging portion so as to receive the pawl unit in the second room, when the ratchet wheel shifts relative to the pawl in the first room, the ratchet wheel is engaged with the pawl and located in the first room;

a spring located in the space and biased between the second room and the pawl, and a clip engaged with the first and second grooves, when the pawl shifts in the second room, the ratchet wheel is restricted by the clip so as to be located within the first room, the ratchet wheel being disengaged from the first room by pushing the ratchet wheel.

2. The ratchet wrench as claimed in claim 1, wherein the angle is in a range of 30 to 45 degrees.

3. The ratchet wrench as claimed in claim 1, wherein the third room is an elongate room and a first rail is located on at least one of a top and a bottom of the handle, a seat is located in the third room to seal a bottom of the third room, the seat has multiple second mounting portions which are hexagonal protrusions, the second mounting portions are accommodated in the first mounting portions of the ratchet wheels in the third room, a cover has a second rail which is slidably engaged with the first rail to seal and a top of the third room.

4. The ratchet wrench as claimed in claim 1, wherein the handle has an open end in which the third room is defined, a rail is defined in each of two insides of the third room, a seat is received in the third room and has multiple second mounting portions which are cylindrical protrusions, the second mounting portions are accommodated in the first mounting portions of the ratchet wheels, the seat includes a rod on each of two sides thereof, the two rods are slidably engaged with the rails of the third room.

5. The ratchet wrench as claimed in claim 1, wherein one of the two engaging plates is connected to the pawl by the bolt, the other one of the two engaging plate is integral with the pawl.

6. The ratchet wrench as claimed in claim 1, wherein the third room has multiple recesses defined therein, each recess receives one of the ratchet wheels, two supports are formed on one end of the handle, a cover includes a pivot which is pivotably connected to the two supports so that the cover is pivotable about the pivot to be mounted to the handle and seal the third room.

* * * * *